US005462298A

United States Patent [19]

Bodine

[11] Patent Number: 5,462,298

[45] Date of Patent: Oct. 31, 1995

[54] WATER HOSE CART

[76] Inventor: Daryl L. Bodine, 1538 Rte. 54, Penn Yan, N.Y. 14527

[21] Appl. No.: 350,454

[22] Filed: Dec. 7, 1994

[51] Int. Cl.[6] ..... B62B 3/10

[52] U.S. Cl. ..... 280/47.34; 280/47.41; 242/399.2; 242/403

[58] Field of Search ..... 280/47.34, 47.371, 280/47.24, 47.28, 47.315, 47.41, 79.6, 79.3, 79.11; 242/399.2, 403, 403.1

[56] References Cited

U.S. PATENT DOCUMENTS

| | | | |
|---|---|---|---|
| D. 164,546 | 9/1951 | Becker | 280/47.24 |
| 4,768,546 | 9/1988 | Brusadin et al. | 242/403.1 |
| 4,974,627 | 12/1990 | Nelson | 242/403.1 |
| 5,007,598 | 4/1991 | Spear et al. | 242/403.1 |
| 5,046,520 | 9/1991 | Sanchez et al. | 242/403.1 |
| 5,308,011 | 5/1994 | Roman | 242/403.1 |
| 5,330,121 | 7/1994 | Eleg | 242/399.2 |

*Primary Examiner*—Richard M. Camby

[57] ABSTRACT

A new and improved water hose cart assembly comprising, in combination, a base in a rectangular configuration having an upper surface and a lower surface. The base has a plurality of axles parallel with each other extending across the width of the base and rotatable wheels secured to the axle exterior of the base. The wheels include a pair of front wheels and a pair of rear wheels. Also provided is a deck which has a rectangular base with an upper surface and a lower surface. The lower surface is positioned adjacent to the upper surface of the base with a circular bearing assembly between the deck and the base for rotation of the deck with respect to the base. The deck has upstanding side brackets on opposite sides thereof with aligned apertures at their upper extents. A spool is positioned on the deck between the side brackets for supporting a reeled hose thereon. The spool has an aperture therethrough aligned with the apertures of the side brackets with a shaft positioned between the apertures of the side brackets and wheel for the rotation thereof and a hose crank for rotation by an operator located exterior of one of the side brackets. A tube coupling extends from the rear end of the base in a horizontal direction and then vertically between the base and the deck with a rotatable coupling therebetween. The tubing then extends to and through one of the side brackets terminating in an inboard fitting and to adjacent the spool for coupling with the hose wound about the spool.

5 Claims, 4 Drawing Sheets

WATER HOSE CART

BACKGROUND OF THE INVENTION

1. Field of the Invention

The present invention relates to water hose carts and more particularly pertains to positioning a watering hose in any of a plurality of locations through a swivel turn table and castor wheels for greater convenience of operation and use.

2. Description of the Prior Art

The use of devices for supporting and positioning garden hoses of a wide variety of designs and constructions is known in the prior art. More specifically, devices for supporting and positioning garden hoses of a wide variety of designs and constructions heretofore devised and utilized for the purpose of moving a garden hose to a variety of sites through a wide variety of methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,512,361 to Tisbo et al a hose storage apparatus.

U.S. Pat. No. 4,768,546 to Brusadin et al discloses a hose winding cart.

U.S. Pat. No. 4,777,976 to Johnston et al discloses a portable hose cart and method of use.

U.S. Pat. No. 4,974,627 to Nelson discloses a garden hose reel caddy.

Lastly, U.S. Pat. No. 5,046,520 to Sanches, Jr., et al discloses a portable hose cart.

In this respect, the water hose cart according to the present invention substantially departs from the conventional concepts and designs of the prior art, and in so doing provides an apparatus primarily developed for the purpose of positioning a watering hose in any of a plurality of locations through a swivel turn table and castor wheels for greater convenience of operation and use.

Therefore, it can be appreciated that there exists a continuing need for a new and improved water hose cart which can be used for positioning a watering hose in any of a plurality of locations through a swivel turn table and castor wheels for greater convenience of operation and use. In this regard, the present invention substantially fulfills this need.

SUMMARY OF THE INVENTION

In view of the foregoing disadvantages inherent in the known types of devices for supporting and positioning garden hoses of a wide variety of designs and constructions now present in the prior art, the present invention provides an improved water hose cart. As such, the general purpose of the present invention, which will be described subsequently in greater detail, is to provide a new and improved water hose cart apparatus and method which has all the advantages of the prior art and none of the disadvantages.

To attain this, the present invention essentially comprises a new and improved water hose cart assembly comprising, in combination, a base in a rectangular configuration having an upper surface and a lower surface. The base has a plurality of axles parallel with each other extending across the width of the base and rotatable wheels secured to the axle exterior of the base. The wheels include a pair of front wheels and a pair of rear wheels. The front wheels are located on castors to effect the movement thereof in one direction or another. Also provided is a deck which has a rectangular base with an upper surface and a lower surface. The lower surface is positioned adjacent to the upper surface of the base with a circular bearing assembly between the deck and the base for rotation of the deck with respect to the base. The deck has upstanding side brackets on opposite sides thereof with aligned apertures at their upper extents. A spool is positioned on the deck between the side brackets for supporting a reeled hose thereon. The spool has an aperture therethrough aligned with the apertures of the side brackets with a shaft positioned between the apertures of the side brackets and wheel for the rotation thereof and a hose crank for rotation by an operator located exterior of one of the side brackets. A tube coupling extends from the rear end of the base in a horizontal direction and then vertically between the base and the deck with a rotatable coupling therebetween. The tubing then extends to and through one of the side brackets terminating in an inboard fitting and to adjacent the spool for coupling with the hose wound about the spool. A locking component is secured to the deck and adapted to be selectively coupled to an aperture in the base for effecting a locking therebetween. The pin is removable from the aperture for allowing the rotation of the deck. A handle is pivotally secured to the front edge of the bases in an inverted U-shaped configuration with pivot pins at the lower free ends secured to the base for pulling the base and deck to an appropriate location. A lock is secured to at least one of the front wheels for securing the wheel in a preset orientation to effect the locking of the base with respect to the ground. The brake is disengageable to allow for the free rotation of its associated wheel for movement of the base to an appropriate location for operation and use.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water hose cart which has all the advantages of the prior art devices for supporting and positioning garden hoses of a wide variety of designs and constructions and none of the disadvantages.

It is another object of the present invention to provide a new and improved water hose cart which may be easily and efficiently manufactured and marketed.

It is a further object of the present invention to provide a new and improved water hose cart which is of a durable and reliable construction.

An even further object of the present invention is to provide a new and improved water hose cart which is susceptible of a low cost of manufacture with regard to both materials and labor, and which accordingly is then susceptible of low prices of sale to the consuming public, thereby making such devices for supporting and positioning garden hoses of a wide variety of designs and constructions economically available to the buying public.

Still yet another object of the present invention is to provide a new and improved water hose cart which provides in the apparatuses and methods of the prior art some of the advantages thereof, while simultaneously overcoming some of the disadvantages normally associated therewith.

Still another object of the present invention is to position a watering hose in any of a plurality of locations through a swivel turn table and castor wheels for greater convenience of operation and use.

Lastly, it is an object of the present invention to provide a new and improved water hose cart assembly comprising, in combination, a base in a rectangular configuration having an upper surface and a lower surface. The base has a plurality of axles parallel with each other extending across the width of the base and rotatable wheels secured to the axle exterior of the base. The wheels include a pair of front wheels and a pair of rear wheels. Also provided is a deck which has a rectangular base with an upper surface and a lower surface. The lower surface is positioned adjacent to the upper surface of the base with a circular bearing assembly between the deck and the base for rotation of the deck with respect to the base. The deck has upstanding side brackets on opposite sides thereof with aligned apertures at their upper extents. A spool is positioned on the deck between the side brackets for supporting a reeled hose thereon. The spool has an aperture therethrough aligned with the apertures of the side brackets with a shaft positioned between the apertures of the side brackets and wheel for the rotation thereof and a hose crank for rotation by an operator located exterior of one of the side brackets. A tube coupling extends from the rear end of the base in a horizontal direction and then vertically between the base and the deck with a rotatable coupling therebetween. The tubing then extends to and through one of the side brackets terminating in an inboard fitting and to adjacent the spool for coupling with the hose wound about the spool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
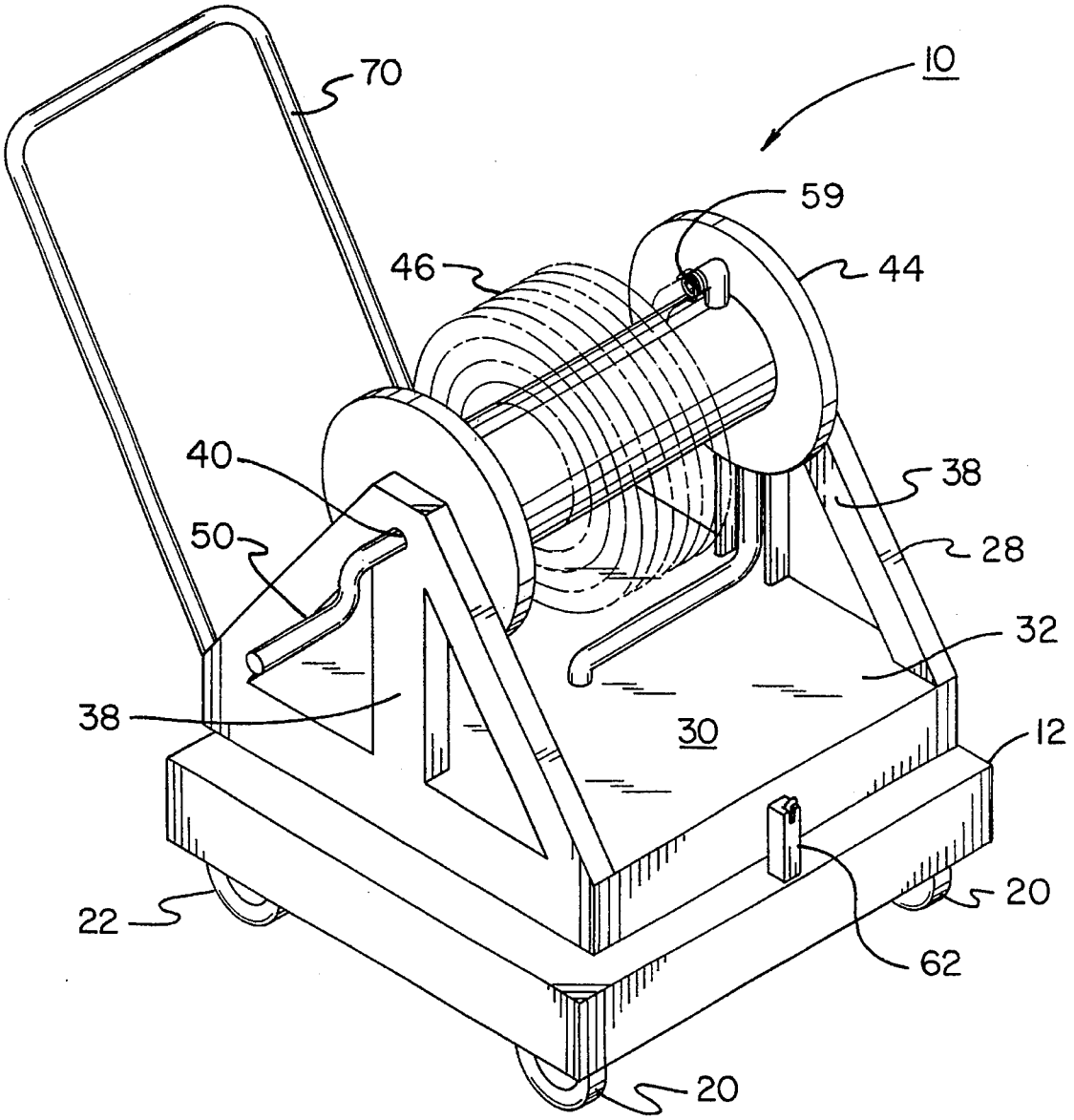
FIG. 1 is a perspective illustration of the preferred embodiment of the water hose cart constructed in accordance with the principles of the present invention.
Figure 2:
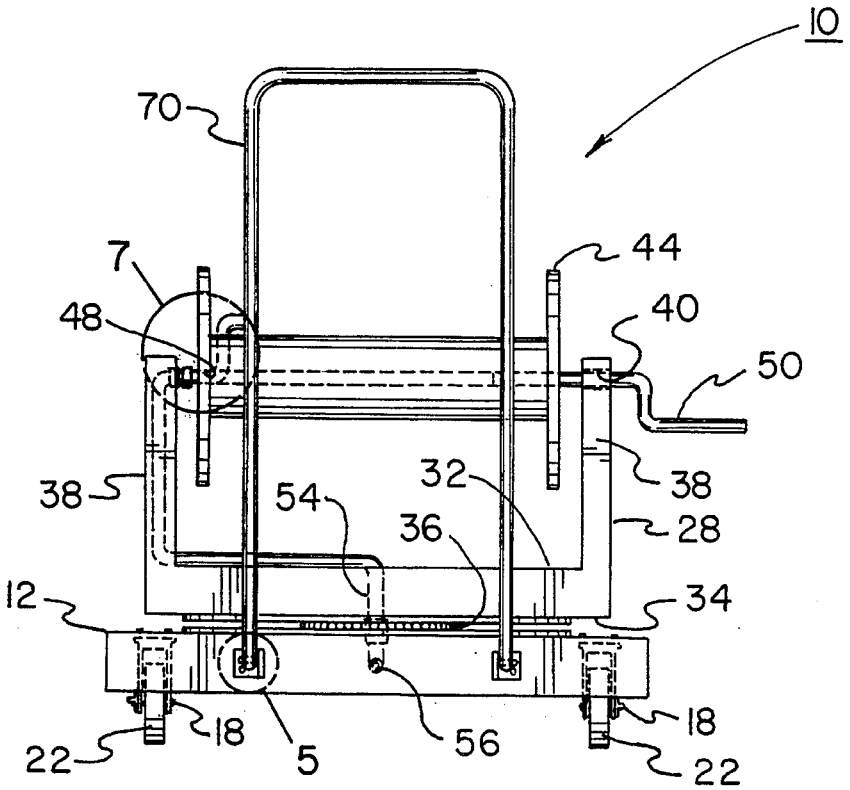
FIG. 2 is a front elevational view of the device shown in FIG. 1.
Figure 3:
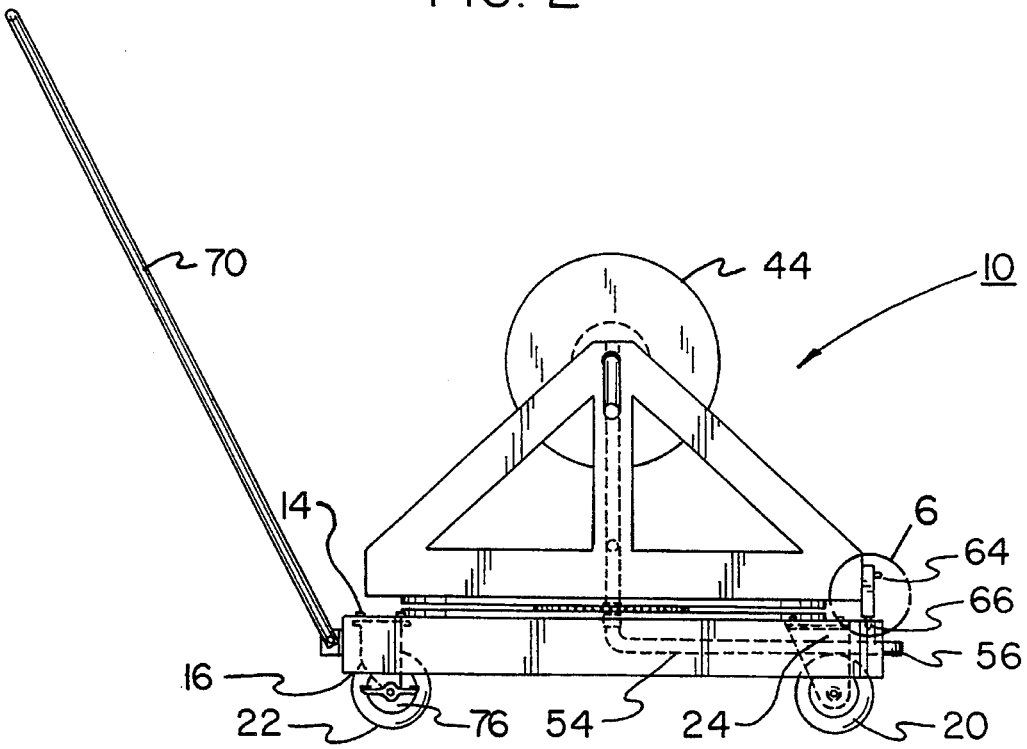
FIG. 3 is a side elevational view of the device shown in FIGS. 1 and 2.
Figure 4:
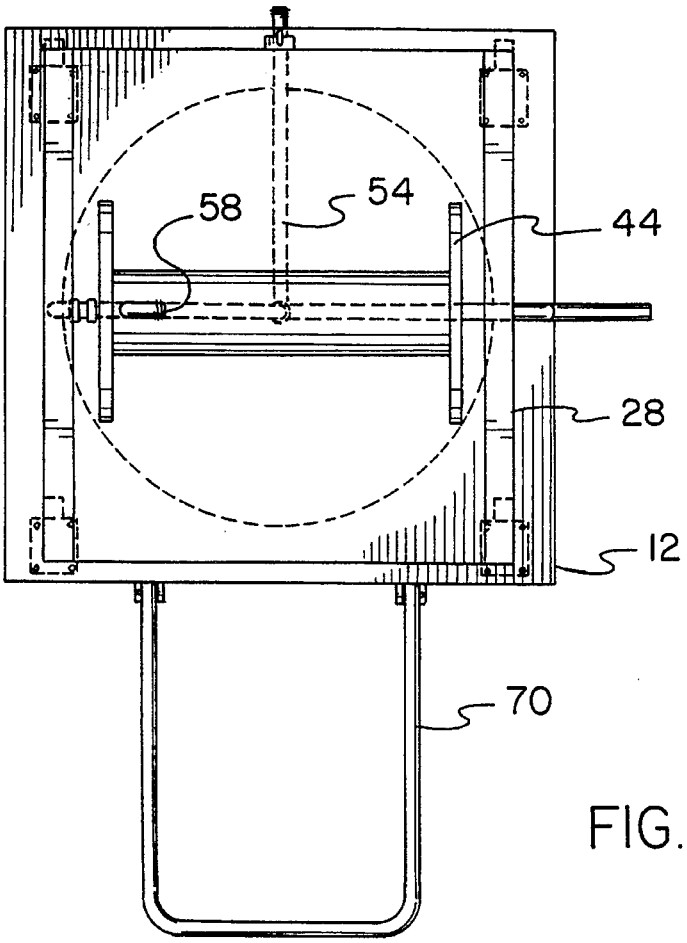
FIG. 4 is a plan view of the device illustrated in the prior Figures.
Figure 5:
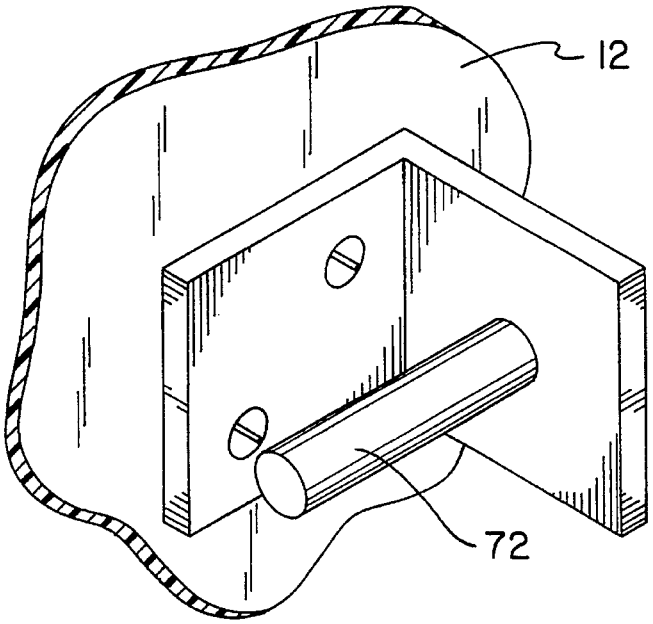
FIG. 5 is an enlarged perspective view taken about circle 5 of FIG. 2.
Figure 6:
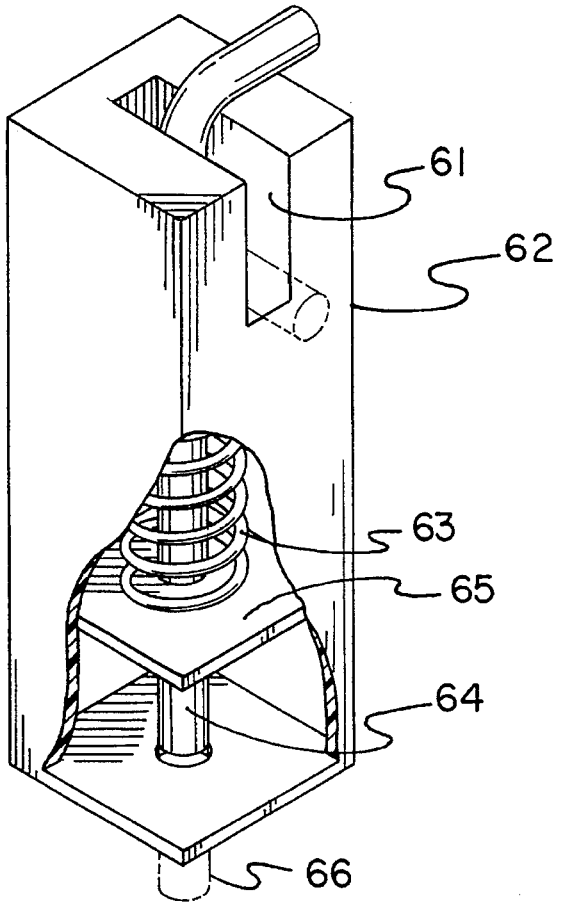
FIG. 6 is an enlarged perspective showing taken about circle 6 of FIG. 3.
Figure 7:
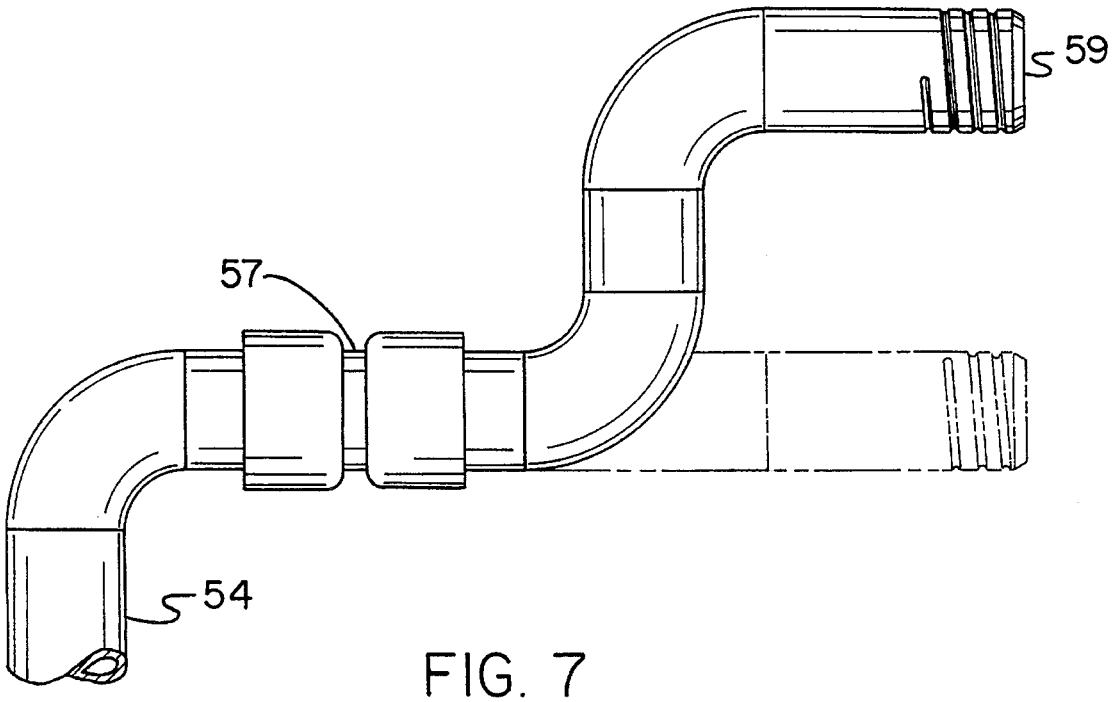
FIG. 7 is an enlarged front elevational view taken about circle 7 of FIG. 2.

With reference now to the drawings, and in particular to FIG. 1 thereof, a new and improved water hose cart embodying the principles and concepts of the present invention and generally designated by the reference numeral 10 will be described.

The present invention, the new and improved water hose cart, is comprised of a plurality of components. Such components in their broadest context include a base, a deck, a spool, a tube, locking components, a handle and a lock. Such components are individually configured and correlated with respect to each other so as to attain the desired objective.

The central component of the water hose cart assembly 10 of the present invention is a base 12. Such base is formed in a rectangular configuration. It has an upper surface 14 and a parallel lower surface 16. The base also has a plurality of axles 18 parallel with respect to each other extending beneath the lower surface of the base. Secured to the axles are a plurality of rotatable wheels 20, 22. Such wheels are exterior of the base. Such wheels include a pair of front wheels 22 and a pair of rear wheels 24. The front wheels are preferably provided with casters 26 to effect movement thereof by rotation about a vertical axis to facilitate the redirecting of the line of motion of the base during operation and use.

Next provided is a deck 28. Such deck is formed with a rectangular base 30. It includes an upper surface 32 and a lower surface 34. The lower surface is positioned adjacent to the upper surface of the base. Therebetween is a circular bearing assembly 36. The circular bearing assembly located between the deck and the base is for the rotation of the deck with respect to the base. The deck is also provided with upstanding side brackets 38. Such are on opposite sides of the base and each includes an aligned aperture 40 at its upper extent.

A spool 44 is rotatably positioned on the deck between and supported by the brackets. The spool is for supporting a reeled hose 46 thereon whereat it may be wound to or wound from the spool.

The spool also has an aperture 48 therethrough. Such aperture 48 is aligned with the apertures of the side brackets. In addition, a shaft 49 is positioned between the apertures of the side brackets and spool for the rotation thereof. A hose crank 50 is provided at one end of the shaft for rotation by an operator. It is located exterior of one side bracket.

Next provided is a tube 50 of a shape with associated couplings 56 extending from the rear end of the base in a horizontal direction and then vertically between the base and the deck. A rotatable coupling is located therebetween. The tubing then extends to and through one of the side brackets terminating in an inboard fitting 58 at its terminal end 59. This is adjacent to the spool for coupling with the hose 46 around the spool. A rotatable coupling 57 with a horizontal axis allows rotation of the spool and hose and adjacent tube during winding and unwinding of the hose 46 on the deck 30. Similarly, a rotatable coupling is provided between the lower end of the tube 54 within the deck 30 and the adjacent tube segment within the base 12. This allows for the rotation of the deck with respect to the base about a vertical axis when the deck is rotated with respect to the base.

Greater convenience is provided by a locking component 62 with a reciprocable pin 64. This is secured to the deck and adapted to be selectively coupled to an aperture 46 at the base for effecting a locking therebetween to preclude rotation. The pin is removable from the aperture for allowing rotation of the deck. A depression 61 in the block supporting the pin allows the lowering to the locking position. A spring 63 coupled to a fixed plate 65 on the pin tends to urge the pin to the locking orientation.

Movement of the assembly is through a handle 70 pivotally secured to the front edge of the base. It is in an inverted U-shaped configuration with pivot pins 72 secured through the lower free ends and secured to the base. This is for positioning the base and deck to an appropriate angular orientation for use by any particular user.

Lastly provided is a lock 76. Such lock is secured to at least one of the front wheels for securing the wheel in a preset orientation to effect the locking of the base with respect to the ground. The lock or break may be disengaged to allow for the free rotation of its associated wheel. This will allow movement of the base to an appropriate location where operation and use is intended.

The present invention comprises a hose cart with an integral turntable that rotates 360 degrees. The turntable enables the hose to be pulled away from any angle without tipping over the cart.

The device resembles a conventional hose cart. It includes a spout to connect to the outside faucet, a shaft around which the hose wraps, and a crank connected to the shaft to enable easy rewinding. The front wheels turn, but include a step-on brake for when the unit must remain in one place. It includes a detachable handle that makes it easy to drag the cart from place to place. The unique feature is a turntable on which the hose shaft sits. This turntable enables the unit to turn with the user, thereby preventing the cart from tipping or falling, as often happens with conventional hose carts. There is a spring-loaded handle connected to the turntable. When it is activated, the unit can turn. If locked, it can not.

To operate, connect the unit to an outside water supply and drag it by the handle to the watering spot. Remove the handle and place it aside, then lock the wheels and release the turntable by flipping the turntable handle down by stepping down on it. Pull out the hose, then water as needed. Use the crank to reel in the hose. Lock the turntable back in place, release the front wheel brake and reattach the handle, then drag back to storage.

This unit improves upon the conventional design. It should appeal to people who are tired of having the hose cart tip over when changing direction.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water hose cart assembly comprising, in combination:

a base in a rectangular configuration having an upper surface and a lower surface, the base having a plurality of axles parallel with each other extending across the width of the base and rotatable wheels secured to the axle exterior of the base, the wheels including a pair of front wheels and a pair of rear wheels, the front wheels being located on castors to effect the movement thereof in one direction or another;

a deck having a rectangular base with an upper surface and a lower surface, the lower surface being positioned adjacent to the upper surface of the base with a circular bearing assembly between the deck and the base for rotation of the deck with respect to the base, the deck having upstanding side brackets on opposite sides thereof with aligned apertures at their upper extents;

a spool positioned on the deck between the side brackets for supporting a reeled hose thereon, the spool having an aperture therethrough aligned with the apertures of the side brackets with a shaft positioned between the apertures of the side brackets and wheel for the rotation thereof and a hose crank for rotation by an operator located exterior of one of the side brackets;

a tube coupling extending from the rear end of the base in a horizontal direction and then vertically between the base and the deck with a rotatable coupling therebetween, the tubing then extending to and through one of the side brackets terminating in an inboard fitting and to adjacent the spool for coupling with the hose wound about the spool;

a locking component secured to the deck and adapted to be selectively coupled to an aperture in the base for effecting a locking therebetween, the pin being removable from the aperture for allowing the rotation of the deck;

a handle pivotally secured to the front edge of the bases in an inverted U-shaped configuration with pivot pins at the lower free ends secured to the base for pulling the base and deck to an appropriate location; and a lock secured to at least one of the front wheels for securing the wheel in a preset orientation to effect the locking of the base with respect to the ground, the brake being disengagable to allow for the free rotation of its associated wheel for movement of the base to an appropriate location for operation and use.

2. A water hose cart comprising:

a base in a rectangular configuration having an upper surface and a lower surface, the base having a pair of axles parallel with each other extending across the width of the base and rotatable wheels secured to the axle exterior of the base, the wheels including a pair of front wheels and a pair of rear wheels;

a deck having a rectangular base with an upper surface and a lower surface, the lower surface being positioned adjacent to the upper surface of the base with a circular bearing assembly between the deck and the base for rotation of the deck with respect to the base, the deck having upstanding side brackets on opposite sides thereof with aligned apertures at their upper extents;

a spool positioned on the deck between the side brackets for supporting a reeled hose thereon, the wheel having an aperture therethrough aligned with the apertures of the side brackets with a shaft positioned between the apertures of the side brackets and wheel for the rotation thereof and a hose crank for rotation by an operator located exterior of one of the side brackets; and a tube coupling extending from the rear end of the base in a horizontal direction and then vertically between the base and the deck with a rotatable coupling therebetween, the tubing then extending to and through one of the side brackets and to adjacent the spool for coupling with the hose wound about the spool.

3. The cart as set forth in claim 2 and further including a locking component secured to the deck and adapted to be selectively coupled to an aperture in the base for effecting a locking therebetween, the pin being removable from the aperture for allowing the rotation of the deck.

4. The cart as set forth in claim 2 and further including a handle pivotally secured to the front edge of the bases in an inverted U-shaped configuration with pivot pins at the lower free ends secured to the base for pulling the base and deck to an appropriate location.

5. The cart as set forth in claim 2 and further including a lock secured to at least one of the front wheels for securing the wheel in a preset orientation to effect the locking of the base with respect to the ground, the brake being disengagable to allow for the free rotation of its associated wheel for movement of the base to an appropriate location for operation and use.

* * * * *